US006666399B2

(12) United States Patent
Perdu

(10) Patent No.: US 6,666,399 B2
(45) Date of Patent: Dec. 23, 2003

(54) SYSTEM FOR TRANSFER AND INVERSION OF A CONTINUOUS WEB SUBSTRATE BETWEEN PRINTING AND OTHER DEVICES

(75) Inventor: Patrick G. L. Perdu, Puntarenas (CR)

(73) Assignee: Xerox Corporation, Stamford, CT (US)

( * ) Notice: Subject to any disclaimer, the term of this patent is extended or adjusted under 35 U.S.C. 154(b) by 90 days.

(21) Appl. No.: 10/125,225

(22) Filed: Apr. 17, 2002

(65) Prior Publication Data

US 2002/0195008 A1 Dec. 26, 2002

Related U.S. Application Data

(60) Provisional application No. 60/299,014, filed on Jun. 18, 2001.

(51) Int. Cl.[7] ..... B65H 23/24

(52) U.S. Cl. ..... 242/615.12; 242/615.21; 101/223; 101/230; 101/257

(58) Field of Search ..... 242/615.12, 615.21; 101/223, 230, 257

(56) References Cited

U.S. PATENT DOCUMENTS 3,548,783 A 12/1970 Knapp ..... 118/224
5,467,179 A 11/1995 Boeck et al. ..... 355/309

*Primary Examiner*—John Q. Nguyen
(74) *Attorney, Agent, or Firm*—Richard F. Spooner; Donald R. Webber

(57) ABSTRACT

An inverting transfer apparatus for continuous web substrate, such as may utilize a single printing system including a conventional or existing simplex web-fed xerographic print engine.

24 Claims, 7 Drawing Sheets

FIG. 4
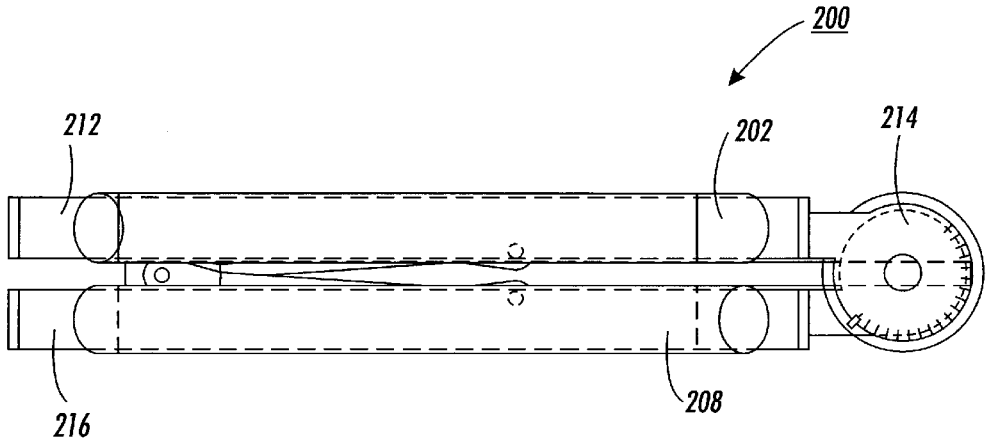
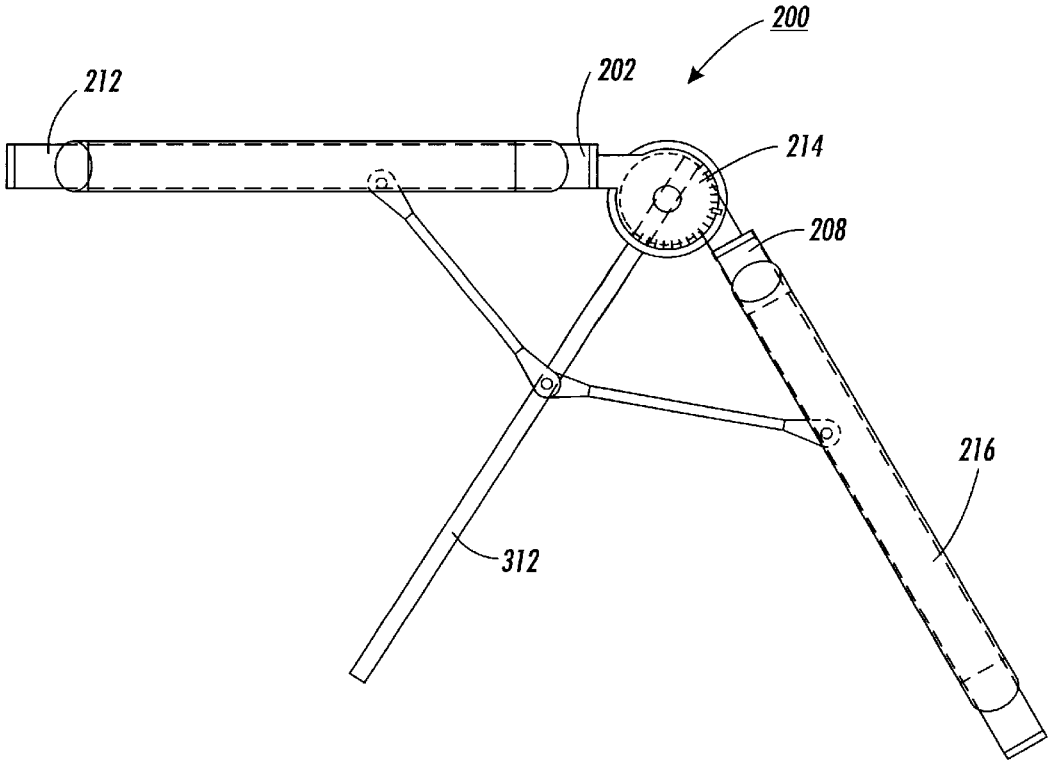
FIG. 5

FIG. 6
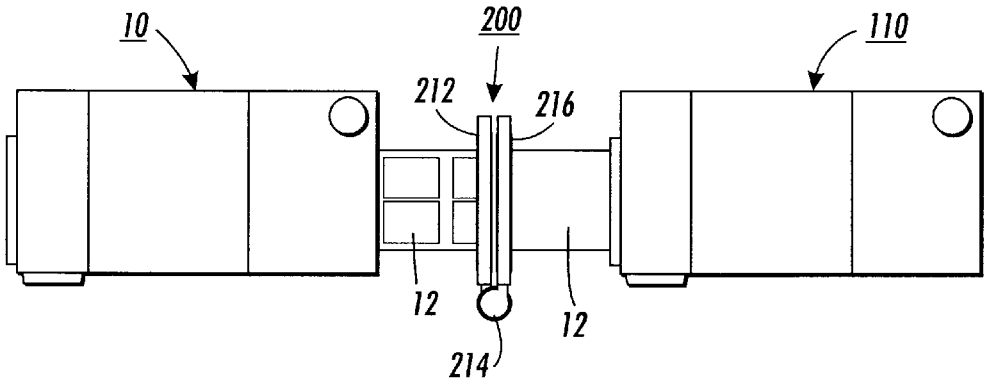
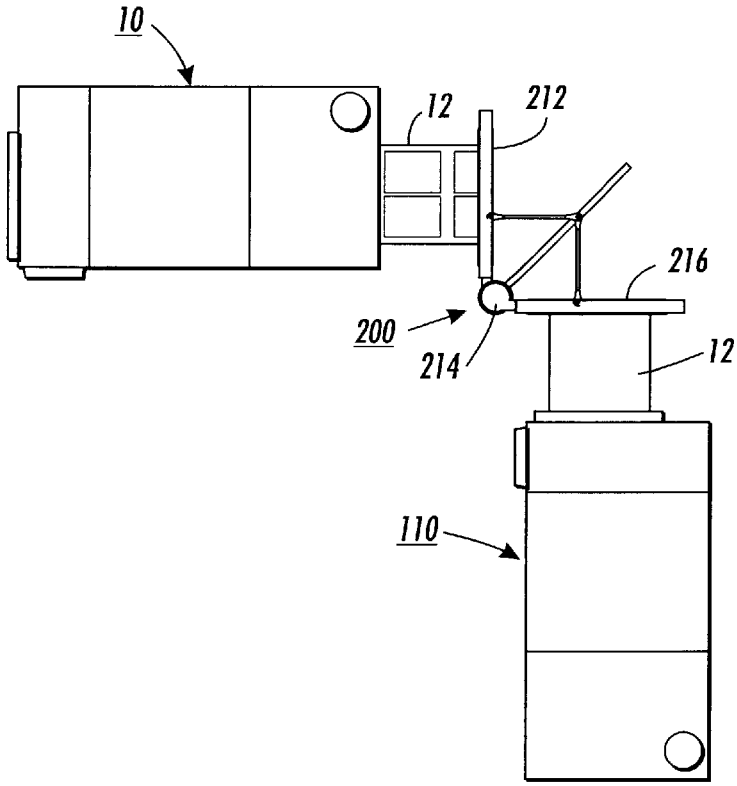
FIG. 7

SYSTEM FOR TRANSFER AND INVERSION OF A CONTINUOUS WEB SUBSTRATE BETWEEN PRINTING AND OTHER DEVICES

CROSS REFERENCE TO RELATED APPLICATIONS

This application is based on a Provisional Patent Application No. 60/299,014, filed Jun. 18, 2001.

Reference is made to commonly-assigned copending U.S. patent application, Ser. No. 10/063,111, filed Mar. 21, 2002, U.S. Pat. No. 6,615,717 entitled: Symmetrical Parallel Duplex Paper Path Device, by Perdu.

BACKGROUND OF THE INVENTION

The invention relates to improvements in transfer of a continuous web substrate between printing, feed, storage, finishing/cutting and/or other devices, especially high speed xerographic printing devices, to include simplex printing systems including or requiring separate, dual, or multiple print engines.

In particular, in the embodiments herein the page images for the opposing sides of the web may be transferred efficiently thereto from single conventional photoreceptor or other imaging surface of a single print engine with two separate but closely spaced and alternatingly engaged image transfer stations, and a special web inversion and variable length web loop control system, in plural page image batches, from a common transfer area.

Several known patents relate to the field of the present invention, and each of the following are hereby incorporated herein in their entirety:

Boeck et al., U.S. Pat. No. 5,467,179 teaches a turnover device for turning a web-shaped recording medium over between two electrophotographic printer or copier devices working in tandem mode, the crossing point of the turning elements is arranged offset a distance of $\pi/\sqrt{2}$ in the direction of the deflector element relative to the middle of the supplied recording medium, taking the cross sectional dimensions of the turning elements into consideration. The lateral offset of the recording medium is thereby avoided. In other words, the web inverting device of Boeck inverts a web and the web exits in the same paper path direction as its entrance path. This fixed path is useful for in-line tandem simplex printers.

Knapp, U.S. Pat. No. 3,548,783 teaches a sheet transport apparatus for both cut sheet and web-type flexible material for changing the path of the material by driving it through guide means curved to change the direction of movement of the flexible material moved therethrough by rollers. By strategically preshaping curved units, paths of feed may be manipulated for inverting the material as the path is changed. A hollow guide track or strategically placed guides and drive rollers are taught by Knapp for use to change the path of the input. In other words, the web inversion apparatus of Knapp requires entrance and exit angles to be fixed and, more particularly, to be fixed at 90 degrees.

It is desired to create a web inversion apparatus that both inverts a web substrate and allows wide flexibility between entrance and exit angles. Such a flexible web inversion apparatus may then be coupled with a wide assortment of printing, copying, finishing, and web supply and receiving devices in a manner that enables a web supplying device to work in tandem with a first web receiving device and then, subsequently, to work in tandem with a second web receiving device without the need to substantially move any of the devices other than change in orientation of the web inversion apparatus.

The disclosed embodiments of the present invention may desirably employ known existing simplex or duplex web printers and peripheral devices/systems. Duplex web printing may performed by inverting a web for printing between serial printers according to a transfer apparatus and/or systems of the present invention which can be moved and or pivoted to any desired location or angle of web entry or exit. The web transfer system described and illustrated herein inverts and transfers the continuous web to and/or from printing and other devices in a variety of variable and flexible scenarios. For example, faster and more reliable handling of the physical image bearing substrate is made possible for xerographic and other copiers, offset and digital printers, and multifunction machines.

In one embodiment of the present invention, a system for inverting a continuous web substrate having a defined direction of movement comprises (a) a continuous web print substrate supply system providing controlled feeding of said continuous web print substrate to a single web print substrate receiving system, and (b) a web transfer apparatus for inverting said continuous web, said transfer apparatus including a hinge point whereby an angle of entry of the web substrate to the web transfer apparatus can be varied relative to an angle of exit of the web substrate web from said web transfer apparatus.

In another embodiment of the present invention, an apparatus for inverting a web substrate having a width dimension, comprises: (a) a hinge assembly having a hinge axis and a first attachment section and a second attachment section placed along said axis; (b) an entrance turning surface, coupled to the hinge assembly within the first hinge attachment section and having an axis extending away from the hinge assembly, said entrance turning surface having an end section away from the hinge assembly; (c) a second turning surface, coupled to the hinge assembly within the second hinge attachment section at a location spaced apart from the first hinge attachment section, said second turning surface being arranged in a plane substantially parallel to the plane containing the axis of the entrance turning surface and that is substantially parallel to the axis of the hinge assembly, said second turning surface having an axis extending away from the hinge assembly and angled toward the end section of the entrance turning surface; (d) an exit turning surface, coupled to the hinge assembly within the second hinge attachment section at an angle adjustable with respect to the angle at which the entrance turning surface is coupled to the hinge assembly, said exit turning surface having an axis extending away from the hinge assembly in a different plane than the plane containing the axis of the entrance turning surface and having an end section away from the hinge assembly; and (e) a third turning surface, coupled to the hinge assembly within the first hinge attachment section at a location spaced apart from the second hinge attachment section, said third turning surface being arranged in a plane substantially parallel to the plane containing the axis of the exit turning member and that is substantially parallel to the axis of the hinge assembly, said third turning surface having an axis extending away from the hinge assembly and angled toward the end section of the exit turning surface; whereby a web paper path is formed within the inverting apparatus by feeding the web over the entrance turning surface, then around the second turning surface toward and around the third turning surface toward the exit turning surface where it is turned before exiting the inverting apparatus.

In another embodiment of the present invention, a web inverting apparatus comprises (a) a hinge assembly and (b)

an entrance module and an exit module, each such module coupled to said hinge assembly such that the hinge assembly provides variability in the angle between the entrance module and the exit module so that a web supply system may feed a web substrate into the entrance module and the web exits the exit module in an orientation substantially inverted to its entrance orientation and so that the web substrate may enter the entrance module at one angle in respect to a web substrate supply system and exit at a different angle.

In yet another embodiment of the present invention, a method for inverting a web substrate in a web inverting device comprises: (a) feeding the web substrate around an entrance turning surface toward a second turning surface, said entrance turning surface being coupled to a hinge assembly within a first attachment section of said hinge assembly and said entrance turning surface having an end section away from the hinge assembly; (b) weaving the web substrate path around the second turning surface toward a third turning surface, said second turning surface being coupled to the hinge assembly within a second hinge attachment section at a location spaced apart from the first hinge attachment section, said second turning surface being arranged in a plane substantially parallel to the plane containing the axis of the entrance turning surface and that is substantially parallel to the axis of the hinge assembly, said second turning surface having an axis extending away from the hinge assembly and angled toward the end section of the entrance turning surface; (c) turning the web substrate path around the third turning surface toward an exit turning surface, said third turning surface being coupled to the hinge assembly within the first hinge attachment section at a location spaced apart from the second hinge attachment section, said third turning surface being arranged in a plane substantially parallel to the plane containing the axis of the exit turning member and that is substantially parallel to the axis of the hinge assembly, said third turning surface having an axis extending away from the hinge assembly and angled toward the end section of the exit turning surface; and (d) exiting the web substrate from the web inverting device by turning the web substrate around the exit turning surface toward a preferred exit orientation, said exit turning surface being coupled to the hinge assembly within the second hinge attachment section at an angle adjustable with respect to the angle at which the entrance turning surface is coupled to the hinge assembly, said exit turning surface having an axis extending away from the hinge assembly in a different plane than the plane containing the axis of the entrance turning surface and having an end section away from the hinge assembly.

In the description herein the term "web" refers to an elongated flexible material of paper, plastic, or other suitable physical substrate for printing images thereon. As to specific components of the subject apparatus, or alternatives therefor, it will be appreciated that, as is normally the case, some similar components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-noted and further features and advantages will be apparent from the specific apparatus and its operation described in the examples below, including the drawing figures (approximately to scale) wherein:

FIG. 4 is a top view of web inverting transfer module of the present invention;

FIG. 5 is a top view of web inverting transfer module of the present invention;

FIG. 6 is a web inverting transfer module and system of the present invention;

FIG. 7 is a web inverting transfer module and system of the present invention;

DETAILED DESCRIPTION OF THE DRAWINGS

Figure 1:
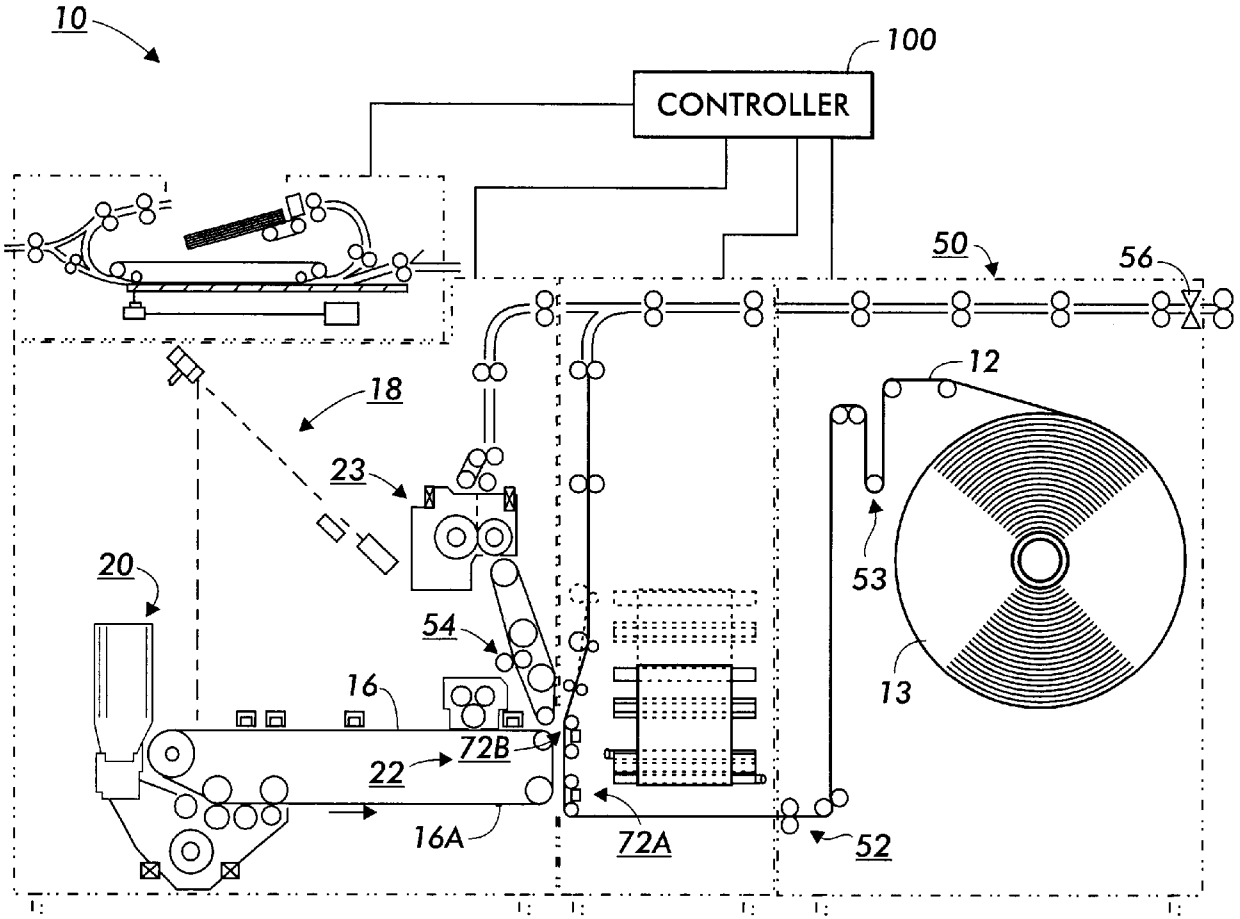
FIG. 1 is a schematic side view of one example of a continuous web simplex printing system with a single xerographic print engine.

FIG. 1 is one example or embodiment of a simplex web printing system 10 for printing page images onto one side of a continuous web substrate 12. The web 12 may be duplex printed on both of its sides, such as by printing on a first side of web 12 utilizing a first web printing system 10, then inverting web 12 and printing on the second (non-imaged) side of 12 utilizing a second web printing system similar to or different from printing system 10 (not shown in FIG. 1). A tensioning roller 53 may be employed to maintain the proper tension on web 12. A pretransfer nip 52 may position the web prior to transfer station 22. The paper supply roll input feed system may be designed to accommodate web steering systems (not shown) to achieve lateral edge registration requirements. The roll 13 from which the continuos web 12 is being fed to be printed in the printing system 10, and various other conventional or known components, may be likewise employed to feed web 12 and need not be fully illustrated or discussed here. Alternatively, web 12 can be fed to printing system 10 via alternate web feeding path 54 (shown in phantom in FIG. 1), rather than being fed from roll 13.

The printing system 10 shows a single exemplary conventional xerographic laser printing engine which is normally only capable of simplex web printing. Various such printers can be used in the subject printing system 10. In this exemplary print engine a conventional single endless belt photoreceptor 16 is being conventionally sequentially latent imaged with page images, such as by a ROS laser printing imaging system 18, or an LED bar, or the like. The latent images are developed with visible image developer material by a development system 20, which may include plural development units for plural colors (not shown in FIG. 1). At an image transfer station area or position 22, the developed images are normally transferred from the photoreceptor 16 to one side of web 12. Within the printing system 10 a conventional xerographic fusing system 23 is provided in which the transferred developed images are fused to web 12.

Printing system 10 may be conventionally controlled by a conventional programmable controller 100, as described above. As per the above-cited art, the controller 100 here may desirably be automatically partially reprogrammed by or in accordance with a particular transfer module adjacent to printing system 10 (not shown in FIG. 1). In particular here, reprogramming the page image spacing and/or sequence on the photoreceptor between that appropriate for image transfers to a continuous web. Further, imaging of cut sheet original documents can be performed under the control of controller 100 using digital recirculating document scanner 50.

In this system 10, the images to be printed may be sequentially transferred to appropriate page order opposing side areas of the continuous web 12. As is known in xerography, in the image transfer area, the web may be driven at the same speed as the photoreceptor by the electrostatic tacking of the paper to the photoreceptor. A conventional corotron or scorotron such as 72 may be mounted behind the web 12 for conventional corona charge toner transfer.

Turning now the further details of the web printing system 10 of FIG. 1, it may be seen that a web paper path system is provided for imaged on a the first side of web 12 at transfer station 72, and fused to web 12 at roll fuser 23. Thereafter, web 12 exits printing system 10 at exit point 56.

As shown, the web may be pushed into and held in the first transfer station 72 against the photoreceptor for first side image transfer by a commonly movable pair of rollers on each side of the transfer corona source for that transfer.

Figure 2:
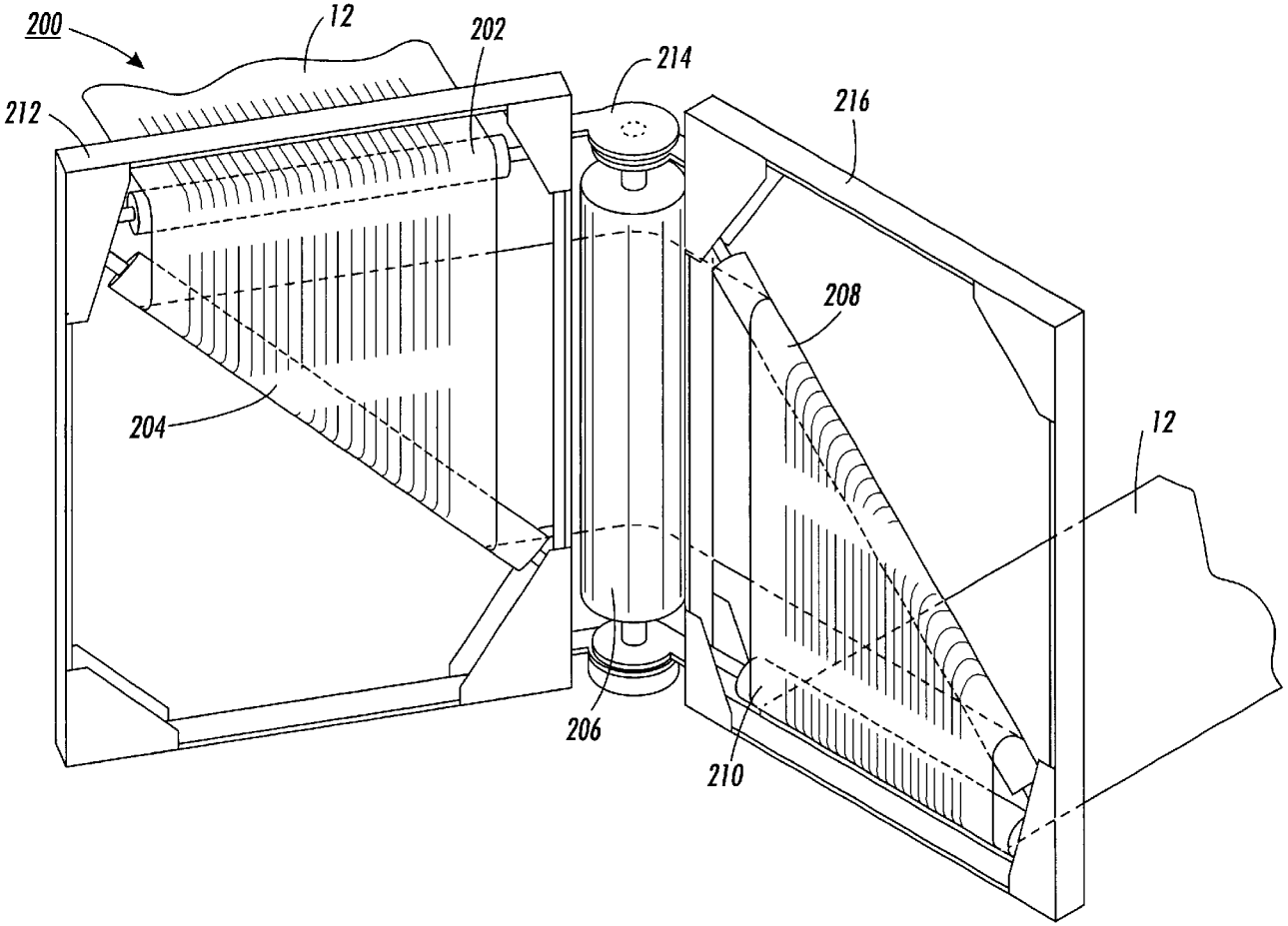
FIG. 2 is a web inverting transfer module of the present invention.

FIG. 2 shows a web inverting transfer apparatus 200 of the present invention that inverts the simplex printed web 12 (such as from printing system 10) in a manner such as will permit web 12 to be imaged on the non-imaged side of web 12 such as by a second printing system 10. Rather than feeding web 12 from roll 13 as shown in FIG. 1, web 12 can be fed to the second printing system 10 via alternate web feeding path 54 via web inverting transfer apparatus 200. Web 12 is fed over roll 202, which forms an entrance turning surface coupled, in this embodiment, to hinge assembly 214 in its top section in an orientation approximately perpendicular to the axis of hinge assembly 214. The web is turned by roll 202 toward and around roll 204 which forms a second turning surface. Roll 204 is coupled to hinge assembly 214 at a position spaced apart from the attachment point of roller 202. Both rolls 202 and 204 are shown mounted on frame 212 which, in turn, is rotatably coupled to hinge assembly 214. The axes of the entrance roll 202 and second turning roll 204 extend away from the hinge assembly and converge proximate to the end section of entrance turning roll 202. Together, entrance turning surface 202 and second turning surface 204 comprise a first module fixedly held in relation to each other within frame 212.

After being turned around turning surface roll 204, web 12 continues around rotatably mounted roller 206 which forms a turning surface with an axis substantially parallel to the axis of the hinge assembly. Thereafter, web 12 continues around roll 208, which forms a third turning surface, and then around roll 210, forming the exit turning surface. As shown, exit roll 208 is coupled to hinge assembly 214 in its top section while third turning surface roll 210 is coupled to hinge assembly 214 at a location spaced apart from roll 208 and, in this embodiment, in an approximately perpendicular orientation to the axis of hinge assembly 214. Both rolls 210 and 208 are shown mounted on frame 216 which, in turn, is rotably coupled to hinge assembly 214. The axes of the exit roll 208 and third turning roll 210 extend away from the hinge assembly and converge proximate to the end section of exit turning roll 208. Together, exit turning surface 208 and third turning surface 210 comprise a second module fixedly held in relation to each other within frame 216.

Roller 206 is rotatably mounted at hinge assembly 214. Hinge assembly, or hinge point, 214 permits the angle between frame 212 and frame 216 to be varied between 0 and 180 degrees in the embodiment shown in FIG. 2. In this manner, multiple printing systems can be positioned at any angle relative to the web output (such as via exit point 56 as shown in FIG. 1) of a first printing system 10 and the web input of a second printing system 10 (such as via web feed path 54 as shown in FIG. 1). Second printing system may be configured in a manner (not shown) as may permit exit of the duplex printed web at an exit point above or below web inverting transfer apparatus 200, for subsequent reeling, cutting into individual sheets or other storage or finishing operations as are well known in the art of printing and document finishing.

Figure 3:
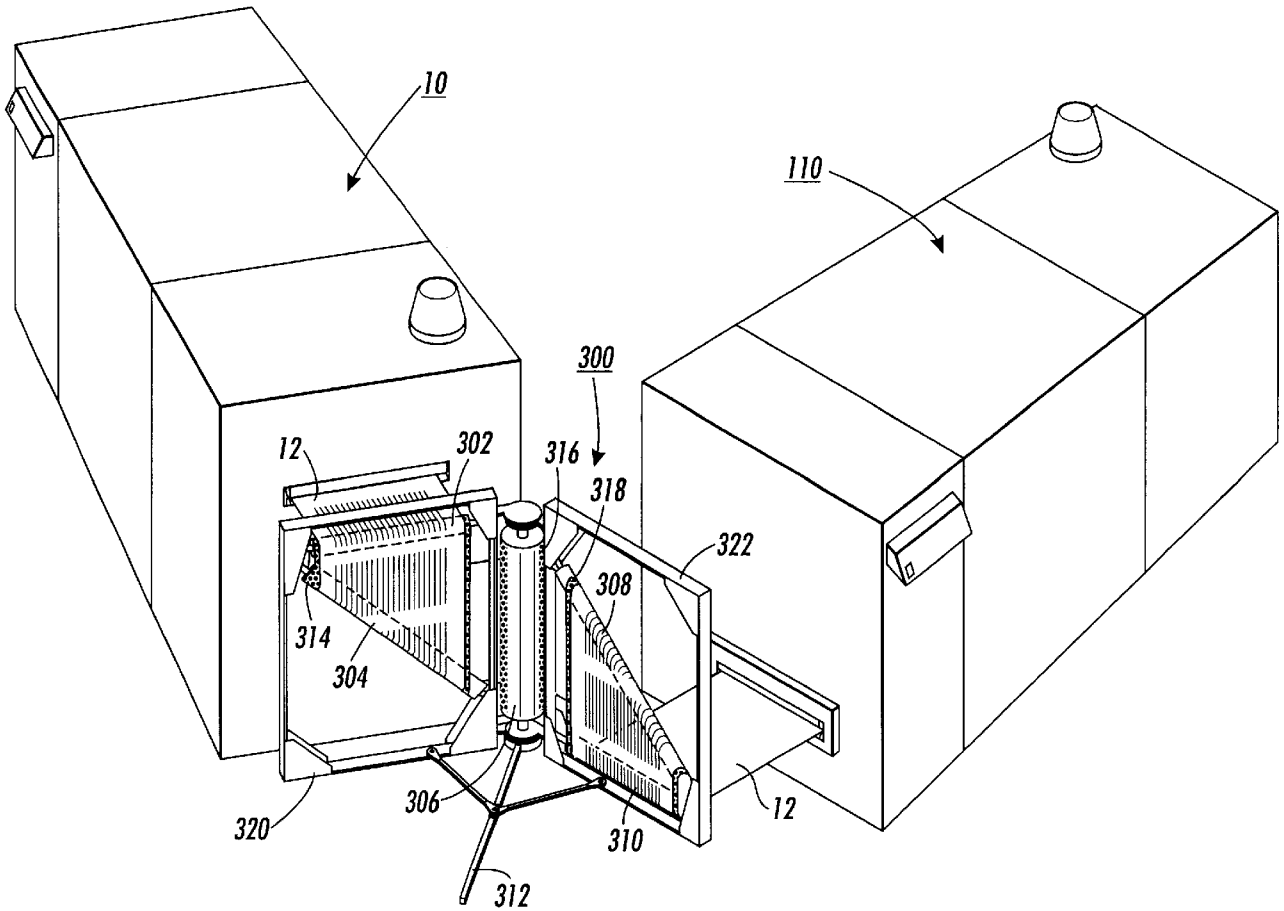
FIG. 3 is a web inverting transfer module and system of the present invention.

FIG. 3 shows a web inverting transfer apparatus 300 of the present invention that inverts the simplex printed web 12 (such as from printing system 10) in a manner such as will permit web 12 to be imaged on the non-imaged side of web 12 such as by a second printing system 110. Rather than feeding web 12 from roll 13 as shown in FIG. 1, web 12 can be fed to the second printing system 10 via alternate web feeding path 54 via web inverting transfer apparatus 300. Web 12 is fed over turn point 302 and then around turn point 304, both shown fixed on perforated turn member 314 mounted on frame 320. Web 12 continues around perforated turn member 316. Thereafter, web 12 continues around turn point 308 and then around turn point 310. Perforated turn members 316, 314, 318 are each supplied with a pressurized air flow from air supply system 306 via air supply lines 301, whereby web 12 moves across each turn point 302, 304, 308 and 310 and perforated turn member 316, while riding on an air cushion provided by air exit perforations in each perforated turn member 314, 318 and 316. Perforated member 316 is mounted at hinge point 324. Hinge point 324 permits the angle between frame 320 and frame 322 to be varied between 0 and 180 degrees in the embodiment shown in FIG. 3. Hinge frame mechanism 312 permits the angle between frame 320 and frame 322 to be fixed in a manner so as to prevent drift or other variance to occur.

In the manner shown in FIG. 3 and as discussed in relation to FIGS. 4 and 5, multiple printing systems or any appropriate web supplying device or web receiving device can be positioned at any angle relative to the web output (such as via exit point 56 as shown in FIG. 1) of a first printing system 10 and the web input of a second printing system 110 (such as via web feed path 54 as shown in FIG. 1).

FIG. 4 shows a top view of web inverting transfer apparatus 200. Roll 202 is shown in this view on frame 212; roll 208 is shown on frame 216. Hinge point 214 permits the angle between frame 212 and frame 216 to be varied to 0 degrees as shown in FIG. 4.

FIG. 5 shows a top view of web inverting transfer apparatus 200. In this case, hinge frame mechanism 312 permits the angle between frame 212 and frame 216 to be fixed in a manner so as to prevent drift or other variance to occur. FIG. 4 shows hinge frame 312 collapsed whereas FIG. 5 shows hinge frame mechanism 312 opening the angle between frames 212 and 216 to approximately 120 degrees.

It can be further understood that a web inverting transfer apparatus of the present invention may include a perforated turn member 316 supplied with a pressurized air flow from air supply system 306 (as shown and described in conjunction with FIG. 3) in combination with a frame 212 with roll 202 and 204, and frame 216, with rolls 208 and 210 (as shown and described in conjunction with FIG. 2). Further, when air supply line 301 supplies air from air supply system 306 to a rotation point such as shown in FIG. 3, perforated turn member 316 may also rotate as web 12 passes over said perforated turn member 316. Likewise, rolls 202, 204, 206, 208 and 210 (as shown in FIG. 2) when supplied with a pressurized air flow from air supply system 306 in a manner as perforated turn member 316 is supplied with a pressurized air flow from air supply system 306 (as shown in FIG. 3), may likewise enable web 12 to be separated by an air cushion from each rotating roll 202, 204, 206, 208 and 210.

FIG. 6 shows a top view of web inverting transfer apparatus 200. Hinge point 214 permits the angle between frame 212 and frame 216 to be varied to 0 degrees as shown in FIG. 4. Web 12 is shown being printed on both sides, by printing on a first side of web 12 with printing system 10, inverting web 12 with web inverting transfer apparatus 200, and then printing on a second side of web 12 with printing system 110.

FIG. 7 shows a top view of web inverting transfer apparatus 200. Hinge point 214 permits the angle between frame 212 and frame 216 to be varied to 90 degrees as shown. Web 12 is shown being printed on both sides, by printing on a first side of web 12 with printing system 10, inverting web 12 with web inverting transfer apparatus 200, and then printing on a second side of web 12 with printing system 110. It is understood that instead of printing system 10, web 12 could be supplied to inverting transfer apparatus 200 by any web substrate supplying device, including, without limitation, roll feeders, interim finisher devices, etc. Similarly, printing system 110 can be replaced by any number of web substrate receiving systems, including, without limitation, roll receivers, finisher devices, post-processing devices, etc.

Figure 8:
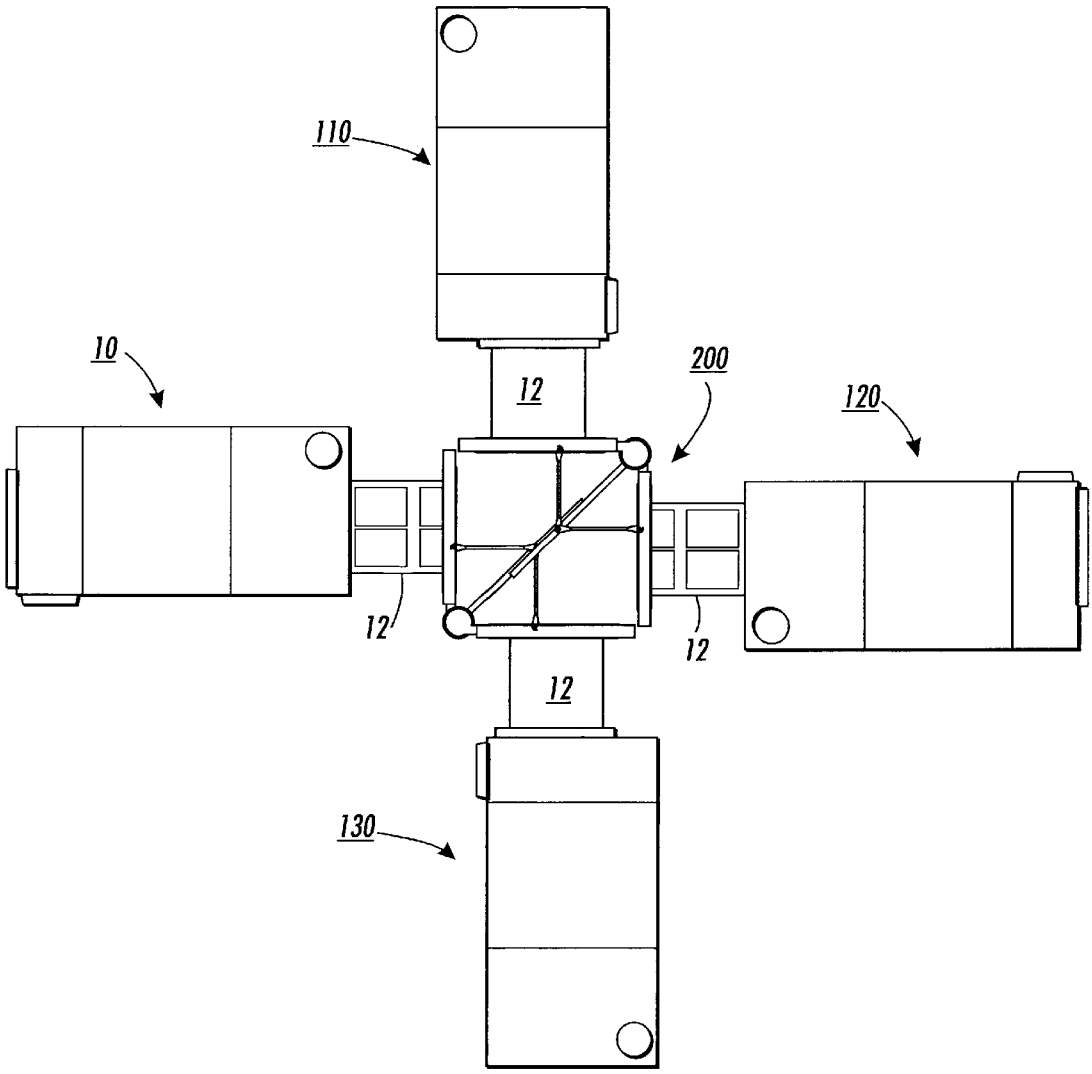
FIG. 8 is a web inverting transfer module and system of the present invention.

FIG. 8 shows a top view of web inverting transfer apparatus 200. Web 12 is shown being printed on both sides, by printing on a first side of web 12 with printing system 120, inverting web 12 with web inverting transfer apparatus 200, and then printing on a second side of web 12 with printing system 110. Printing systems 10 and 130 are shown idle; with rotation of and/or varying the angle of entry and exit of web 12, web inverting transfer apparatus 200 can be used to feed between any of printing systems 10, 110, 120 and 130 so as to print on both sides of web 12.

Figure 9:
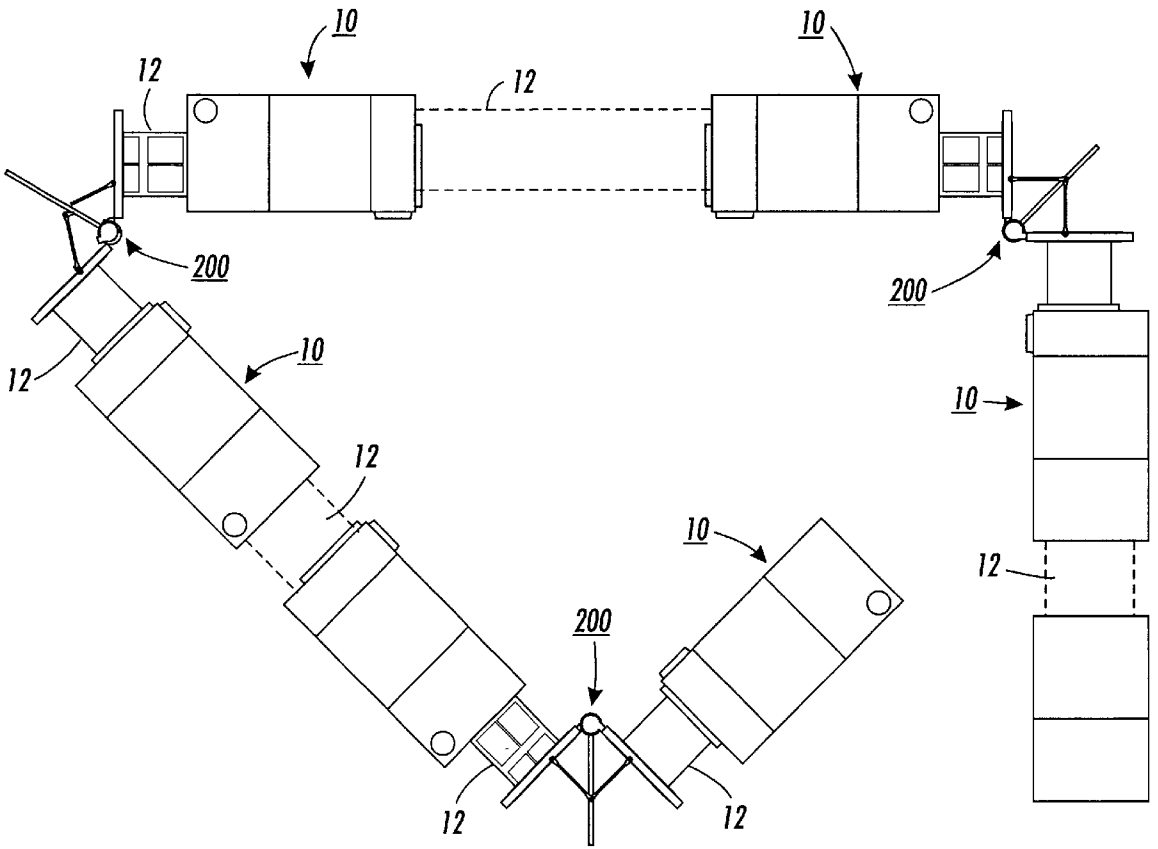
FIG. 9 is a web inverting transfer module and system of the present invention.

FIG. 9 likewise shows a top view of web inverting transfer apparatus 200. Web 12 is shown being printed on both sides, by printing on a first side of web 12 with printing system 10, inverting web 12 with web inverting transfer apparatus 200, and then printing on a second side of web 12 with a second printing system 10.

A finisher 5 (such as for cutting the web into individual sheets and otherwise stacking, stapling or processing said individual sheets) is shown as idle in FIG. 9. A web storage reel (such as for feeding web 12 as shown by roll 13 in FIG. 1) is likewise shown as idle in FIG. 9. By varying the position and angle of web inverting transfer apparatus 200, finisher 5 or web storage reel 7 may engage web 12 during activation. In this manner, multiple printing systems, web feeders, finishers and other devices can be positioned at any angle relative to the web output for inversion and transport via a web inverting transfer apparatus of the present invention.

Variously disclosed in the above embodiments is an architecture and method for accomplishing two sided printing on a single imaging or print engine (xerographic or other) onto a continuous web. While the embodiments disclosed herein are preferred, it will be appreciated from this teaching that various alternatives, modifications, variations or improvements therein may be made by those skilled in the art, which are intended to be encompassed by the following claims.

What is claimed is:

1. In a system for inverting a continuous web substrate having a defined direction of movement, the improvement comprising;

a continuous web print substrate supply system providing controlled feeding of said continuous web print substrate to a single web print substrate receiving system, a web transfer apparatus for inverting said continuous web, said transfer apparatus including a hinge assembly whereby an angle of entry of the web substrate to the web transfer apparatus can be varied relative to an angle of exit of the web substrate from said web transfer apparatus.

2. The system of claim 1, wherein at least one of said web print substrate supply system and web print substrate receiving system is a simplex web printing system.

3. The system of claim 1, wherein said web transfer apparatus includes rollers forming at least one web turning surface.

4. The system of claim 1, wherein said web transfer apparatus includes an air cushion roller forming at least one web turning surface.

5. The system of claim 1, wherein said web transfer apparatus includes an air cushion member forming at least one web turning surface.

6. The system of claim 1, wherein a t least one of said print substrate supply system and web print substrate receiving system further comprises a plurality of systems disposed such that the web transfer apparatus operates in conjunction with a first one of the plurality of systems when the hinge assembly is disposed at a first angle and operates in conjunction with a second one of the plurality of systems when the hinge assembly is disposed at a second angle.

7. An apparatus for inverting a web substrate, comprising:

a. a hinge assembly having a hinge axis and a first attachment section and a second attachment section placed along said axis;

b. an entrance turning surface, coupled to the hinge assembly within the first hinge attachment section and having an axis extending away from the hinge assembly, said entrance turning surface having an end section away from the hinge assembly;

c. a second turning surface, coupled to the hinge assembly within the second hinge attachment section at a location spaced apart from the first hinge attachment section, said second turning surface being arranged in a plane substantially parallel to the plane containing the axis of the entrance turning surface and that is substantially parallel to the axis of the hinge assembly, said second turning surface having an axis extending away from the hinge assembly and angled toward the end section of the entrance turning surface;

d. an exit turning surface, coupled to the hinge assembly within the second hinge attachment section at an angle adjustable with respect to the angle at which the entrance turning surface is coupled to the hinge assembly, said exit turning surface having an axis extending away from the hinge assembly in a different plane than the plane containing the axis of the entrance turning surface and having an end section away from the hinge assembly; and e. a third turning surface, coupled to the hinge assembly within the first hinge attachment section at a location spaced apart from the second hinge attachment section, said third turning surface being arranged in a plane substantially parallel to the plane containing the axis of the exit turning member and that is substantially parallel to the axis of the hinge assembly, said third turning surface having an axis extending away from the hinge assembly and angled toward the end section of the exit turning surface; whereby a web paper path is formed within the inverting apparatus by feeding the web over the entrance turning surface, then around the second turning surface toward and around the third turning surface toward the exit turning surface where it is turned before exiting the inverting apparatus.

8. The web inverting apparatus of claim 7, wherein the adjustable angle between the coupling angle of the exit turning surface and the coupling angle of the entrance turning surface is adjustable between 0 and 180 degrees.

9. The web inverting apparatus of claim 7, whereby the axis of the entrance turning surface is substantially perpendicular to the axis of the hinge assembly.

10. The web inverting apparatus of claim 7, whereby the axis of the exit turning surface is substantially perpendicular to the axis of the hinge assembly.

11. The web inverting apparatus of claim 7, whereby each of the angles between axes of turning surfaces as well as the angles between the axis of the hinge assembly and axes of the turning surfaces is substantially equal to angles selected from the set of angles consisting of 90 degrees and 45 degrees.

12. The web inverting apparatus of claim 7, wherein at least one of the planes that are substantially parallel to the axis of the hinge assembly contains the axis of the hinge assembly.

13. The web inverting apparatus of claim 7, further comprising a fifth turning surface disposed in the paper path between the second turning surface and the third turning surface, said fifth turning surface having an axis substantially parallel to the axis of the hinge assembly.

14. The web inverting apparatus of claim 13, wherein at least one turning surface emits an air cushion.

15. The web inverting apparatus of claim 13, wherein at least one turning surface comprises a roller member.

16. The web inverting apparatus of claim 7, further comprising a hinge frame member, wherein the entrance turning surface and the second turning surface are coupled as an entrance module, wherein the exit turning surface and the third turning surface are coupled as an exit module, and wherein the hinge frame member is coupled between the entrance module and the exit module so that the angle between the entrance module and the exit module is held substantially constant during operation of the inverting device.

17. The web inverting apparatus of claim 7, wherein the adjustable angle between the coupling angle of the exit turning surface and the coupling angle of the entrance turning surface is adjusted to align the axis of the entrance turning surface substantially perpendicular to and in line with the web supply direction of a web substrate supply system and to align the axis of the exit turning surface substantially perpendicular to and in line with the receiving direction of a web substrate receiving system.

18. The web inverting apparatus of claim 17, wherein at least one of said web substrate supply system and web substrate receiving system further comprises a plurality of systems disposed such that the web inverting apparatus operates in conjunction with a first one of the plurality of systems when the hinge assembly is disposed at a first angle and operates in conjunction with a second one of the plurality of systems when the hinge assembly is disposed at a second angle.

19. The web inverting apparatus of claim 17, wherein at least one of the web substrate receiving system and the web substrate supply system is a simplex web printing system.

20. A web inverting apparatus, comprising:

a. a hinge assembly;

b. an entrance module and an exit module, each such module coupled to said hinge assembly such that the hinge assembly provides variability in the angle between the entrance module and the exit module so that a web supply system feeds a web substrate into the entrance module and the web substrate exits the exit module substantially inverted to its entrance orientation and at an angle in respect to the web substrate supply system different from its entrance angle.

21. The web inverting apparatus of claim 20, wherein the angle between web substrate entrance and web substrate exit from the web inverting apparatus may vary between 0 and 180 degrees.

22. The web inverting apparatus of claim 20, further comprising a hinge frame member coupled between the entrance module and the exit module so that the angle between the entrance module and the exit module is held substantially constant during operation of the web inverting apparatus.

23. The web inverting apparatus of claim 20, wherein the web substrate exits toward a web substrate receiving system and wherein at least one of said web substrate supply system and web substrate receiving system further comprises a plurality of systems disposed such that the web inverting apparatus operates in conjunction with a first one of the plurality of systems when the hinge assembly is disposed at a first angle and operates in conjunction with a second one of the plurality of systems when the hinge assembly is disposed at a second angle.

24. A method for inverting a web substrate in a web inverting device, comprising:

a. feeding the web substrate around an entrance turning surface toward a second turning surface, said entrance turning surface being coupled to a hinge assembly within a first attachment section of said hinge assembly and said entrance turning surface having an end section away from the hinge assembly;

b. weaving the web substrate path around the second turning surface toward a third turning surface, said second turning surface being coupled to the hinge assembly within a second hinge attachment section at a location spaced apart from the first hinge attachment section, said second turning surface being arranged in a plane substantially parallel to the plane containing the axis of the entrance turning surface that is substantially parallel to the axis of the hinge assembly, said second turning surface having an axis extending away from the hinge assembly and angled toward the end section of the entrance turning surface;

c. turning the web substrate path around the third turning surface toward an exit turning surface, said third turning surface being coupled to the hinge assembly within the first hinge attachment section at a location spaced apart from the second hinge attachment section, said third turning surface being arranged in a plane substantially parallel to the plane containing the axis of the exit turning member that is substantially parallel to the axis of the hinge assembly, said third turning surface having an axis extending away from the hinge assembly and angled toward the end section of an exit turning surface; and d. exiting the web substrate from the web inverting device by turning the web substrate around the exit turning surface toward a preferred exit orientation, said exit turning surface being coupled to the hinge assembly within the first hinge attachment section at an angle adjustable with respect to the angle at which the entrance turning surface is coupled to the hinge assembly, said exit turning surface having an axis extending away from the hinge assembly in a different plane than the plane containing the axis of the entrance turning surface and having an end section away from the hinge assembly.

* * * * *